US008682207B2

(12) United States Patent
Fujioka

(10) Patent No.: US 8,682,207 B2
(45) Date of Patent: Mar. 25, 2014

(54) IMAGE FORMING APPARATUS WITH A SEAMLESS BELT AND A TENSILE FORCE APPLYING MECHANISM FOR THE SEAMLESS BELT

(75) Inventor: Michio Fujioka, Aichi (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 206 days.

(21) Appl. No.: 13/031,637

(22) Filed: Feb. 22, 2011

(65) Prior Publication Data

US 2011/0211861 A1 Sep. 1, 2011

(30) Foreign Application Priority Data

Feb. 26, 2010 (JP) ..... 2010-042529

(51) Int. Cl.
*G03G 15/16* (2006.01)
*G03G 21/00* (2006.01)

(52) U.S. Cl.
USPC ..... 399/101; 399/345

(58) Field of Classification Search
USPC ..... 399/101, 99, 303, 312, 345
See application file for complete search history.

(56) References Cited

U.S. PATENT DOCUMENTS 6,963,715 B2 11/2005 Kanekura et al.
7,899,355 B2 3/2011 Sakuma
8,023,856 B2 9/2011 Okazaki
8,185,002 B2 5/2012 Takahashi
2003/0161652 A1* 8/2003 Nishiwaki ..... 399/101
2006/0285872 A1* 12/2006 Fukuta et al. ..... 399/99

FOREIGN PATENT DOCUMENTS

JP 2004004398 A 1/2004
JP 2004310131 A 11/2004
JP 2005-107053 4/2005
JP 2007-041124 2/2007
JP 2007-140144 6/2007
JP 2007178560 A 7/2007
JP 2007286647 A 11/2007
JP 2008015365 A * 1/2008
JP 2009104066 A 5/2009
JP 2009186600 8/2009
JP 2009276438 A 11/2009

OTHER PUBLICATIONS

Notification of Reasons for Rejection for JP 2010042529 dated Apr. 9, 2013.

* cited by examiner

*Primary Examiner* — Billy Lactaoen
(74) *Attorney, Agent, or Firm* — Banner & Witcoff, Ltd.

(57) ABSTRACT

An image forming apparatus is provided. The image forming apparatus includes an image forming unit to transfer an image onto a transfer medium in an image transfer range, a seamless belt to move along a predetermined conveying direction, a pair of belt rollers to support the belt in a flattened condition, a tensile force applier to become in contact with the belt and apply tensile force to the belt in the image transfer range, a controller to apply the tensile force during an imaging period, in which operations including an image transfer operation are executed, and reduce or clear the tensile force being applied to the belt during a non-imaging period, which is other than the imaging period.

15 Claims, 5 Drawing Sheets

IMAGE FORMING APPARATUS WITH A SEAMLESS BELT AND A TENSILE FORCE APPLYING MECHANISM FOR THE SEAMLESS BELT

CROSS REFERENCE TO RELATED APPLICATION

This application claims priority from Japanese Patent Application No. 2010-042529, filed on Feb. 26, 2010, the entire subject matter of which is incorporated herein by reference.

BACKGROUND

1. Technical Field

An aspect of the present invention relates to an image forming apparatus, specifically to an image forming apparatus having an image forming unit and a belt unit with a seamless belt.

2. Related Art

An image forming apparatus having a belt unit and an image forming unit with a colorant (e.g., toner) container is known. The belt unit may include a driving roller, a driven roller, and a seamless belt to roll around the driving and driven rollers. The seamless belt may be rolled to convey a transfer medium (e.g., a sheet of paper) on a surface thereof, and an image formed in the image forming unit may be transferred onto the sheet when the sheet being conveyed on the belt comes to a position to face the image forming unit.

In this regard, quality of the image appearing on the transfer medium can be affected by various factors, such as timing of the image transfer on the transfer medium and condition of the belt rolling in the belt unit. Therefore, in order to maintain desired imaging quality, it is preferred that the surface of the belt is maintained flat and straightened at least at the part, which faces the image forming unit.

In order to maintain the straightened surface of the belt, the belt unit may have a compression spring in vicinity of the driven roller, which presses the driven roller outward in a direction to be away from the driving roller, so that the belt rolling around the driving roller and the driven roller is tensely stretched outward.

SUMMARY

In the image forming apparatus in such a configuration, the compression spring constantly presses the driven roller outward regardless of activation and inactivation of the image forming unit. Meanwhile, in order to maintain the belt in the stretched condition, the compression spring is required to have a predetermined level of compression force. Therefore, when the belt is stretched outward constantly by the compression spring, even when the belt is not rolling, the belt may be forced to have a form of an outer periphery of the driven roller by the pressure of the compression spring. Thus, the belt may tend to have irregular convexities and protuberances in the surface, and the irregular deformation of the belt may affect the positional relation between the image forming unit and the recording medium being conveyed on the belt. In other words, the quality of images formed on the recording medium being conveyed on the belt may be deteriorated.

In view of the above deficiencies, the present invention is advantageous in that an image forming apparatus, having an image forming unit and a belt unit with an endless belt, in which desired condition of the endless belt to carry the recording medium is maintained, is provided.

According to an aspect of the present invention, an image forming apparatus, which is capable of transferring an image onto a transfer medium, is provided. The image forming apparatus includes an image forming unit, which is configured to form the image to be transferred onto the transfer medium, a seamless belt, which is configured to move in a predetermined conveying direction to convey the transfer medium in an image transfer range, a pair of belt rollers, which are arranged in positions to define a most downstream portion and a most upstream portion of a stream of the belt moving in the predetermined conveying direction and configured to support the belt in a flattened condition, a tensile force applier, which is configured to become in contact with the belt and generate resistance against the belt moving in the predetermined conveying direction and apply tensile force to the belt in the image transfer range, and a controller, which is configured to control the tensile force applier to apply the tensile force to the belt in the image transfer range during an imaging period, in which operations including an image transfer operation are executed, and control the tensile force applier to one of reduce and clear the tensile force being applied to the belt during a non-imaging period, which is other than the imaging period.

According to another aspect of the present invention, an image forming apparatus, which is capable of transferring an image onto a transfer medium, is provided. The image forming apparatus includes an image forming unit, which is configured to form the image to be transferred onto the transfer medium, a seamless belt, which is configured to move in a predetermined conveying direction to convey the transfer medium in an image transfer range, a pair of belt rollers, which are arranged in positions to define a most downstream portion and a most upstream end portion of a stream of the belt moving in the predetermined conveying direction and configured to support the belt in a flattened condition, and a tensile force applier, which is configured to become in contact with the belt and generate resistance against the belt moving in the predetermined conveying direction and apply tensile force to the belt in the image transfer range. The tensile force applier includes a roller configured to become in contact with the belt to generate the resistance against the moving belt. The roller is configured to rotate in a rotation velocity, which is different from a moving velocity of the belt moving in the predetermined conveying direction.

According to still another aspect of the present invention, an image forming apparatus, which is capable of transferring an image onto a transfer medium, is provided. The image forming apparatus includes an image forming unit, which is configured to form the image to be transferred onto the transfer medium, a seamless belt, which is configured to move in a predetermined conveying direction to convey the transfer medium in an image transfer range, a pair of belt rollers, which are arranged in position to define a most downstream portion and a most upstream portion of a stream of the belt moving in the predetermined conveying direction and configured to support the belt in a flattened condition, a tensile force applier, which is configured to become in contact with the belt and generate resistance against the belt moving in the predetermined conveying direction and apply the tensile force to the belt in the image transfer range, and a controller, which is configured to control the tensile force applier to apply the tensile force to the belt in the image transfer range during an imaging period, in which operations including an image transfer operation are executed, and control the tensile force applier to one of reduce and clear the tensile force being applied to the belt during a non-imaging period, which is other than the imaging period. The tensile force applier includes a cleaning roller, which is configured to become in contact with a surface of the belt facing the image forming unit and to remove residue from the surface of the belt. A path to direct the transfer medium to the belt is formed in a position between the tension generator and the image transfer range.

BRIEF DESCRIPTION OF THE ACCOMPANYING DRAWINGS

DETAILED DESCRIPTION

Hereinafter, embodiments according to the present invention will be described with reference to the accompanying drawings.

First Embodiment

Figure 1:
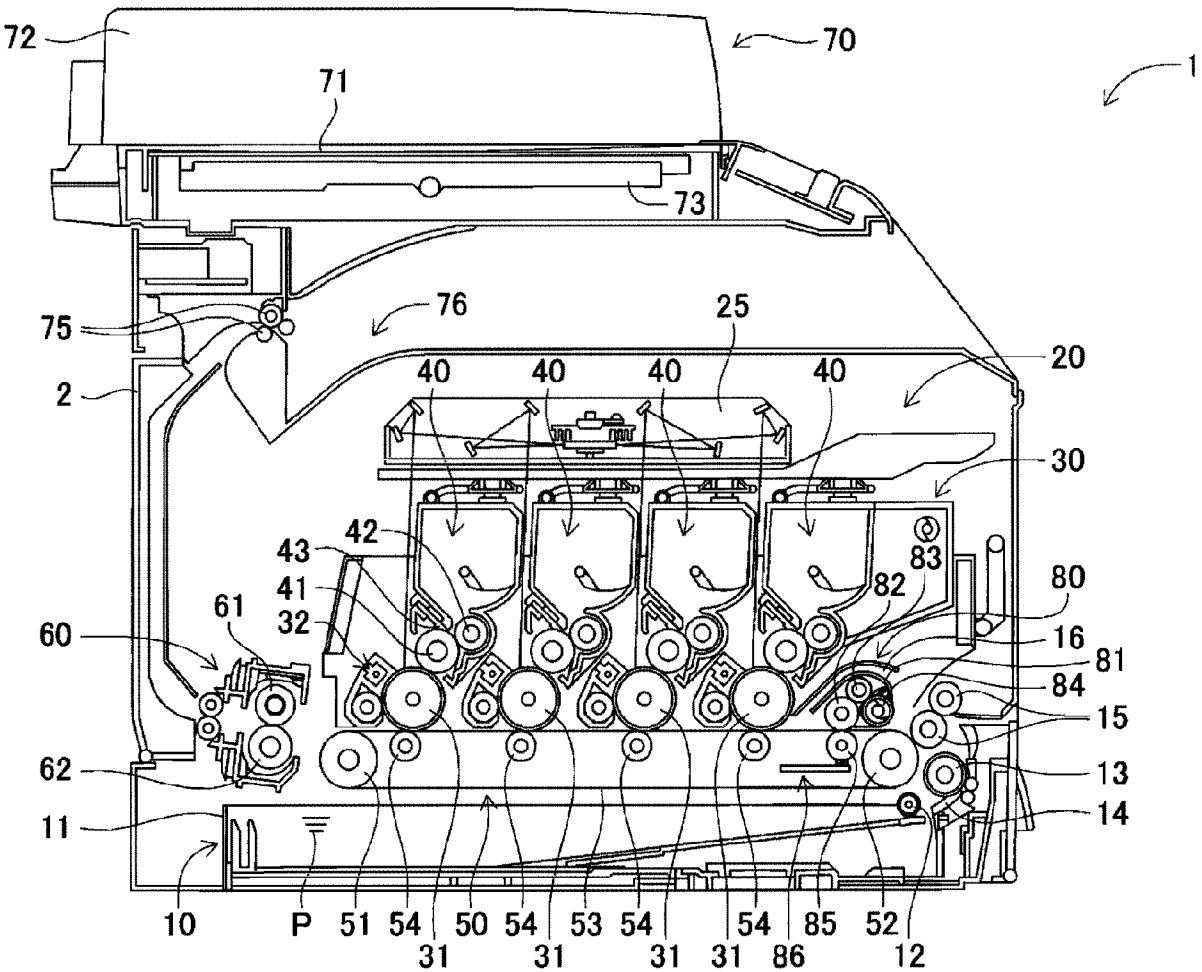
FIG. 1 is a cross-sectional side view of a laser printer according to an embodiment of the present invention.

An overall configuration of a laser printer 1 according to a first embodiment of the present invention will be described with reference to FIG. 1. In the description below, directions concerning the laser printer 1 will be referred to based on a user's position to use the laser printer 1. That is, a viewer's right-hand side appearing in FIG. 1 is referred to as a front face of the laser printer 1, and left-hand side in FIG. 1 opposite from the front side is referred to as rear. A side which corresponds to the viewer's nearer side is referred to as left, and an opposite side from the left, which corresponds to the viewer's further side, is referred to as right. The up-down direction in FIG. 1 corresponds to a vertical direction of the laser printer 1.

The laser printer 1 is a multicolor laser printer, having a sheet-feed unit 10, an image forming unit 20, an image reader unit 70, and a casing 2, which accommodates the sheet-feed unit 10 and the image forming unit 20.

The sheet-feed unit 10 feeds a sheet P of paper being a transfer medium in a sheet-feeding path to the image forming unit 20, which forms an image on the fed sheet P based on inputted print data. The image reader unit 70 reads an image of a source document set in the image reader unit 70. Thus, the laser printer 1 serves as a multifunction peripheral (MFP) having the image forming function and the image reading function.

The sheet-feed unit 10 of the laser printer 1 includes a sheet-feed tray 11 in a bottom section in the casing 2. The sheet-feed tray 11 accommodates the sheets P to be fed and is detachably attached to the bottom section of the casing 2. The sheet-feed unit 10 further includes a feed roller 12, a separator roller 13, a separator pad 14, register rollers 15, and a guiding path 16.

The feed roller 12 is arranged in an upper front position with respect to the sheet-feed tray 11. As the feed roller 12 rotates, a topmost sheet P in the sheet-feed tray 11 is picked up and fed in the sheet-feeding path.

The separator roller 13 is arranged in a frontward and spaced-apart position with respect to the sheet-feed roller 12. The separator pad 14 is arranged in a lower position with respect to the separator roller 13 to be in contact with a lower part of the separator roller 13. The separator roller 13 cooperates with the separator pad 14 to separate the topmost sheet P from succeeding sheets P so that the sheets P are conveyed in the sheet-feeding path one-by-one.

The register rollers 15 are arranged in upper positions with respect to the separator roller 13 and the separator pad 14. The register rollers 15 correct an orientation of the sheet P conveyed from the separator roller 13 with respect to the sheet-feeding path and convey the sheet P further to the image forming unit 20.

Figure 2:
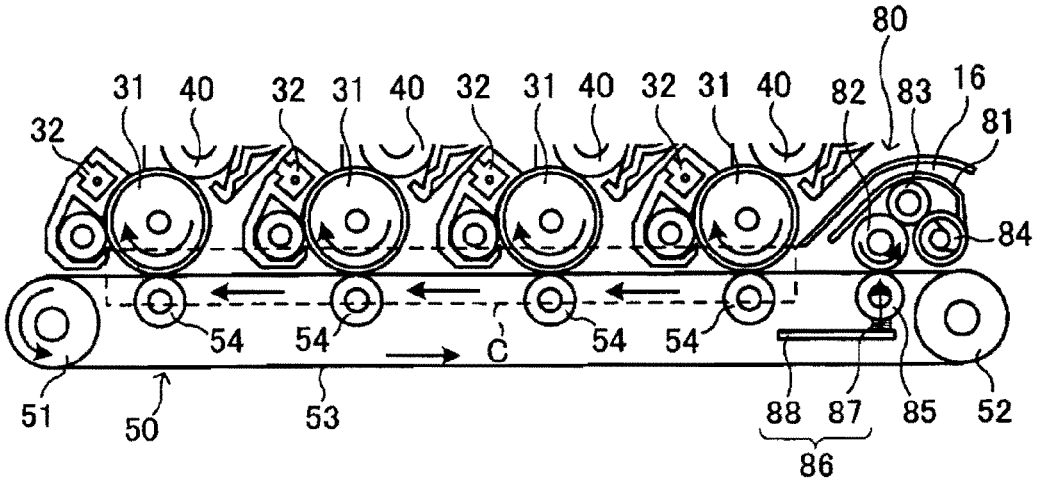
FIG. 2 is an enlarged partial view of a transfer unit and neighboring components in the laser printer according to the embodiment of the present invention.

The guiding path 16 guides the sheet P being conveyed from the register rollers 15 along a top of a cleaning unit 80 and to a position rearward with respect to the cleaning unit 80 and frontward with respect an image transfer range C (see FIG. 2). The cleaning unit 80 will be described later in detail.

The image forming unit 20 will be described herein-below in detail. The image forming unit 20 includes a scanner unit 25, a processing unit 30, a transfer unit 50, and a fixing unit 60.

The scanner unit 25 is a known scanning device having polygon mirrors and arranged in an upper position in the casing 2. In the scanner unit 25, laser beams are emitted based on the inputted print data, and surfaces of photosensitive drums 31 are exposed to the laser beams. The photosensitive drums 31 will be described later.

The processing unit 30 is arranged in a lower position with respect to the scanner unit 25 and an upper position with respect to the transfer unit 50. The processing unit includes four developer cartridges 40, which are for image-forming in black, yellow, magenta, and cyan. The developer cartridges 40 are aligned in line along the right-left direction of the laser printer 1 and arranged to be spaced apart from one another. The developer cartridges 40 contain one of black, yellow, magenta, and cyan toners. In the present embodiment, the developer cartridges 40 containing the black toner, the yellow toner, the magenta toner, and the cyan toner are aligned along the front-rear direction in the order described.

Each of the developer cartridges 40 is provided with a developer roller 41, a supplier roller 42, and a flattening blade 43. The developer roller 41 is rotatably supported at a lowermost position in the developer cartridge 40 and arranged to be in contact with the photosensitive drum 31 from above. The supplier roller 42 supplies the toner in the developer cartridge 40 to the developer roller 41. The flattening blade 43 restricts thickness of a layer of the toner supplied to the developer roller 41 so that the layer of toner on the developer roller 41 is maintained within predetermined thickness.

The processing unit 30 further includes the four photosensitive drums 31 and four chargers 32. Each of the photosensitive drums 31 is provided for one of the black, yellow, magenta, and cyan colors and arranged in a lower position with respect to the corresponding developer cartridge 40. Each of the chargers 32 is arranged in an upper position with respect to one of the photosensitive drums 31 to be spaced apart from a surface of the photosensitive drum 31.

Developing behaviors of the processing unit 30 will be described. The toner contained in the developer cartridge 40 is stirred by rotation of an agitator (not shown) and supplied to the developer roller 41 via the supplier roller 42. In this regard, the toner is positively charged by friction occurring between the supplier roller 42 and the developer roller 41. The positively-charged toner is flattened in a layer by the flattening blade 43 and rotation of the developer roller 41 to be carried by the surface of the developer roller 41.

Meanwhile, a surface of the photosensitive drum 31 is positively charged evenly by the charger 32 as the photosensitive drum 31 rotates. The positively-charged surface of the photosensitive drum 31 is exposed to the laser beam emitted from the scanner unit 25, and potential in the exposed regions in the surface of the photosensitive drum 31 is lowered. Accordingly, a latent image, which corresponds to the image to be formed on the sheet P, is formed on the surface of the photosensitive drum 31.

As the photosensitive drum 31 with the latent image rotates further, the positively-charged toner is supplied to the latent image on the surface of the photosensitive drum 31 from the surface of the developer roller 41. Thus, the latent image is developed to be a toner image on the surface of the photosensitive drum 31.

Figure 7:
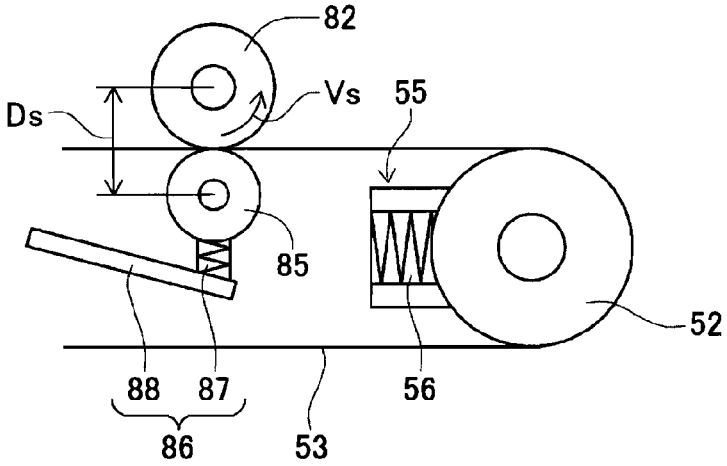
FIG. 7 illustrates movement of the cleaning unit in the laser printer during a pre-print operation and a post-print operation according to the embodiment of the present invention.
Figure 8:
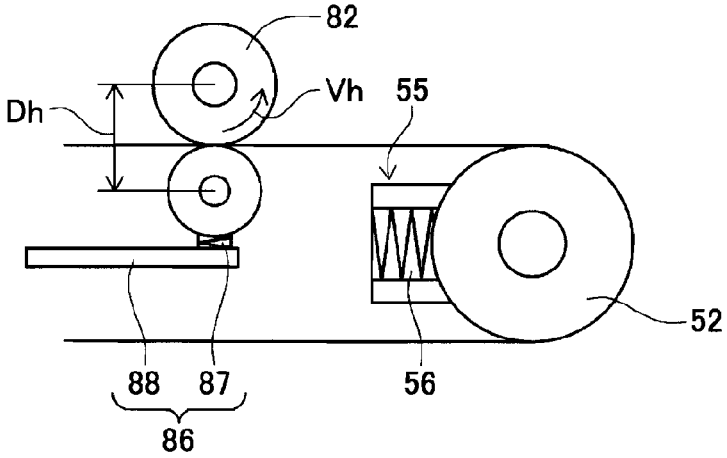
FIG. 8 illustrates movement of the cleaning unit in the laser printer during a print operation according to the embodiment of the present invention.

Next, the transfer unit 50 will be described in detail. The transfer unit 50 is disposed in an upper position with respect to the sheet-feed unit 10 and a lower position with respect to the processing unit 30 in the casing 2. The transfer unit 50 includes a driving roller 51, a driven roller 52, a conveyer belt 53, four transfer rollers 54, and an adjustor 55 (see FIGS. 6-8) and is arranged along the front-rear direction of the laser printer 1.

The driving roller 51 is rotatably supported in the casing 2 at a lower position with respect to a rear end of the processing unit 30. The driving roller 51 is rotated in a predetermined direction (e.g., counterclockwise in FIGS. 1 and 2) according to activation of a first driving motor 91 (see FIG. 3). The first driving motor 91 will be described later in detail. Meanwhile, the driven roller 52 is rotatably supported in the casing 2 at a lower position with respect to a front end of the processing unit 30. The adjustor 55 includes a coil spring 56, which resiliently expands to press the driven roller 53 frontward in the laser printer 1. The driven roller 52 is rotated along rolling movement of the conveyer belt 53, which is rolled by rotation of the driving roller 51.

The conveyer belt 53 is a seamless belt to roll around the driving roller 51 and the driven roller 52. In particular, the driving roller 51 and the driven roller 52 define a downstream end portion and an upstream end portion of a stream of the rolling conveyer belt 53. An upper surface and a lower surface of the conveyer belt 53 supported by the driving roller 51 and the driven roller 52 are maintained flat, and as the driving roller 51 rotates, the conveyer belt 53 circulates in a predetermined direction (e.g., counterclockwise in FIGS. 1 and 2). In this regard, due to the expanding force of the coil spring 56 of the adjustor 55, tensile force is applied to the driven roller 52, and the conveyer belt 53 is tensely stretched. The tension to stretch the conveyer belt 53 due to the adjustor 55 is maintained to be too small to form convexities or protuberance on the surface of the conveyer belt 53. Meanwhile, the tension in the conveyer belt 53 is maintained to be intense to prevent the conveyer belt 53 from being easily displaced from the driving roller 51 or the driven roller 52. Whilst being tensely stretched, an upper and outer surface of the conveyer belt 53 is in contact with the photosensitive drums 31. Thus, the conveyer belt 53 moves rearward in the laser printer 1 at the upper section thereof according to the rotation of the driving roller 51.

The transfer rollers 54 are arranged in positions opposite from the photosensitive drums 31 across the upper section of the conveyer belt 53. In particular, the transfer rollers 54 are arranged in positions to be in contact with the upper inner surface of the conveyer belt 53 and rotatable according to the movement of the conveyer belt 53.

As the upper section of the conveyer belt 53 moves rearward, the sheet P fed from the sheet-feed unit 10 is carried along the conveyer belt 53 in the image transfer range C, in which the photosensitive drums 31 and the transfer rollers 54 face each other via the conveyer belt 53. Whilst the sheet P on the conveyer belt 53 is carried in between the photosensitive drums 31 and the transfer rollers 54, the toner images in black, yellow, magenta, and cyan colors formed on the surfaces of the photosensitive drums 31 are transferred onto the sheet P. Thus, the colored image is formed to appear on the sheet P.

Next, the fixing unit 60 will be described in detail. The fixing unit 60 is arranged in a rear position with respect to the transfer unit 50 and includes a heat roller 61 and a pressure roller 62. The heat roller 61 heats the colored image formed on the sheet P to thermally fix the colored image thereat. The pressure roller 62 is arranged in a position opposite from the heat roller 61 to press the sheet P against the heat roller 61. Thus, as the sheet P passes a nipped position between the heat roller 61 and the pressure roller 62, the colored image on the sheet P is fixed there-onto.

The sheet P with the thermally-fixed colored image is carried upward within the casing 2 to discharge rollers 75. The discharge rollers are rotatably supported at a rear end of a discharge tray 76, which is formed in an upper section with respect to the scanner unit 25, and convey the sheet P to be ejected out of the chassis 2. The ejected sheet P is settled in the discharge tray 76.

Next, the image reader unit 70 in the laser printer 1 will be described in detail. The image reader unit 70 is disposed in an upper position with respect to the discharge tray 76 and includes a document platen 71, a cover 72, and an image reader 73. The document platen 71 is a platform, on which a source document to be read is placed, and may be configured with a piece of contact glass. The cover 72 is rotatably supported by the document platen 71 and presses the document placed on the document platen 71 downward to fix the document in a predetermined reading position. The image reader 73 includes an image capturing element (e.g., contact image scanner) and reads an image in the document, which is placed on the document platen 71.

The laser printer 1 is further provided with a cleaning unit 80. The cleaning unit 80 removes residual toner, which remains even after the image transfer on the outer surface of the conveyer belt 53, therefrom. Moreover, the cleaning unit 80 according to the present embodiment can be controlled by a controller program (see FIGS. 4 and 5) to adjust the tensile force to be applied to the conveyer belt 53 in image transfer range C.

The cleaning unit 80 is arranged in a rear position with respect to the driven roller 52 and a front position with respect to the image transfer range C. In other words, the cleaning unit 80 is in a downstream position along a direction of sheet-conveyance and an upper stream position along the direction of sheet-conveyance. The cleaning unit 80 includes a frame 81, a cleaning roller 82, an intermediate roller 83, a residual toner container 84, a backup roller 85, and a presser 86.

The frame 81 is arranged in a downstream (rear) position with respect to the driven roller 52, which is in a frontmost position in the transfer unit 50, in an upstream (front) position with respect to the image transfer range C, and in an upper position with respect to the transfer unit 50. The frame 81 rotatably supports the cleaning roller 82 and the intermediate roller 83 and holds the residual toner container 84. Further, a top surface of the frame 81 defines a part of the guiding path 16.

The cleaning roller 82 is disposed in a rear position with respect to the driven roller 52 and a front position with respect to the image transfer range C. The cleaning roller 82 is aligned with the right-left direction (i.e., a direction of width of the conveyer belt 53) and rotatably supported by the frame 81. The cleaning roller 82 is rotated at a predetermined rotation velocity according to activation of a second driving motor 92 (see FIG. 3), which is controlled by a controlling program (see FIG. 4). A lower end section of the cleaning roller 82 is exposed from a lower end of the frame 81, and the cleaning roller 81 is in contact with the upper outer surface of the conveyer belt 53 at the exposed lower end section. When cleaning bias is applied to the cleaning roller 82, the cleaning roller 82 absorbs the residual toner from the outer surface of the moving conveyer belt 53.

The intermediate roller 83 is arranged in an upper front position with respect to the cleaning roller 82 and aligns along the right-left direction. The intermediate roller 83 is rotatably supported by the frame 81 and arranged in a position to be in contact with a surface of the cleaning roller 82 so that the intermediate roller 83 removes the toner adhered on the surface of the cleaning roller 82 and releases the removed toner in the residual toner container 84. The residual toner container 84 is arranged in a lower front position with respect to the intermediate roller 83 to align with the right-left direction. The residual toner container 84 is formed to have an opening in an upper position, and the residual toner released from the intermediate roller 83 is dropped through the opening to be stored in the residual toner container 84.

When the image is transferred onto the surface of the sheet P in the image transfer range C, that a portion of the toner, which is to be used for the image transfer, may scatter to fall on the outer surface of the conveyer belt 53. The toner adhered onto the conveyer belt 53 is carried along the rolling movement of the conveyer belt 53 and turned downward at the driving roller 51 and upward at the driven roller 52 to face the cleaning roller 82.

When the toner on the conveyer belt 53 comes to face the cleaning roller 82, the toner is absorbed by the cleaning roller 82 with the effect of the cleaning bias applied to the cleaning roller 82. The absorbed toner is passed to the intermediate roller 83 and stored in the residual toner container 84. The toner in the residual toner container 84 is conveyed by a toner conveyer (not shown) to a waste toner container (not shown), which is arranged in an upper section in the processing unit 30.

The cleaning unit 80 according to the present embodiment is provided with a backup roller 85 in a position opposite from the cleaning roller 82 across the conveyer belt 53. The backup roller 85 is rotatably supported by the presser 86.

The presser 86 includes a spring 87 and a support 88. The support 88 is swingably supported at a rear end thereof and has the backup roller 85 and the spring 87 at a front end thereof. The support 88 is moved to swing about the rear end thereof upward and downward according to activation of a third driving motor 93 (see FIG. 3), which is controlled by a controlling program (see FIG. 5), so that the front end of the support 88 is moved to a predetermined position. The backup roller 85, which is rotatably supported at the front end of the support 88, swings along with the swing movement of the support 88 (see FIGS. 6-8). The spring 87 is arranged in a position between the backup roller 85 and the support 88 and cab apply upward expanding force thereof to the backup roller 85.

When the backup roller 85 is placed in a position to become in contact with the upper inner surface of the conveyer belt 53 (see FIGS. 7 and 8), the backup roller 85 nips the conveyer belt 53 with the cleaning roller 82. Thus, the backup roller 85 serves as a backing, with which the cleaning roller 82 works in cooperation when the cleaning roller 82 removes the residual toner from the conveyer belt 53.

As has been mentioned above, the backup roller 85 is movable to change the position thereof; therefore, intensity of the pressure from the backup roller 85 to press the conveyer belt 53 against the cleaning roller 82 is changeable by adjusting the position of the backup roller 85. In other words, the intensity of the pressure to nip the conveyer belt 53 between the cleaning roller 82 and the backup roller 85 is controllable and changeable.

Figure 3:
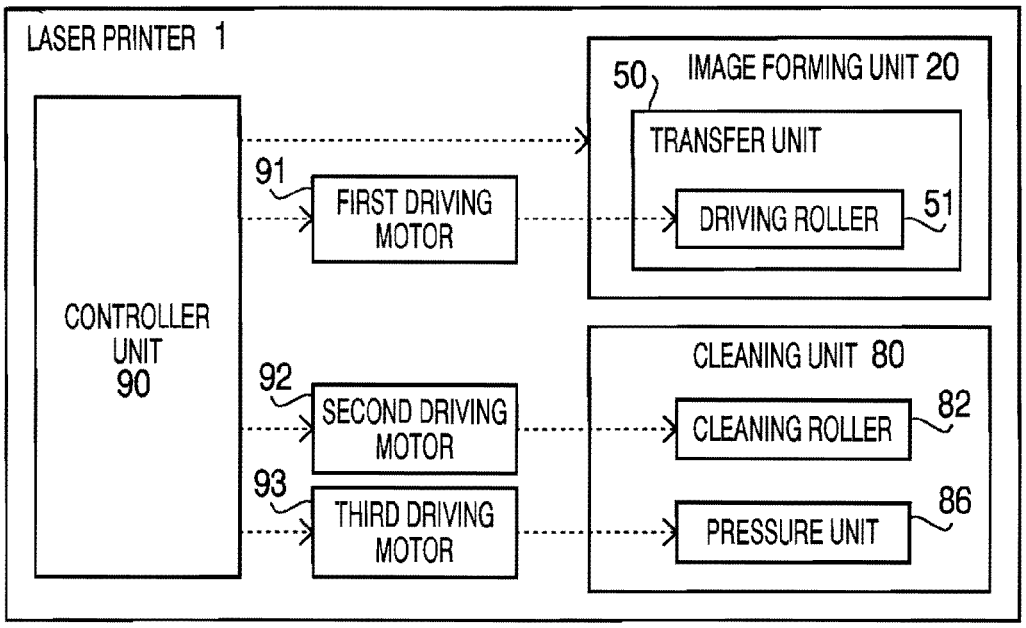
FIG. 3 is a block diagram to illustrate a controlling system of the laser printer according to the embodiment of the present invention.

Next, behaviors of the laser printer 1 to form an image will be described with reference to FIG. 3. The description hereinbelow specifically features the image-forming behaviors of the laser printer 1, and behaviors of the sheet-feed unit 10 and the image reader unit 70 are omitted.

The laser printer is provided with a controller unit 90, which includes a CPU, a ROM, and a RAM (not shown), to control the behaviors of the laser printer 1. The ROM stores various kinds of data and controlling programs to be used to control the laser printer 1.

The controller unit 90 is connected with the image forming unit 20 and the first driving motor 91 and controls the image forming unit 20 in accordance with a known image forming program to form an image on the sheet P. The first driving motor 91 provides a driving source to drive the driving roller 51 in the transfer unit 50. Thus, the controller unit 90 controls activation of the first driving motor 91 to move the conveyer belt 53 in the predetermined rolling direction (see FIG. 2) at a predetermined conveying velocity B.

Further, the controller unit 90 is connected with the second driving motor 92 and with the third driving motor 93. The second driving motor 92 provides a driving source to drive the cleaning roller 82 in the cleaning unit 80. The controller unit 90 controls activation of the second driving motor 92 according to a controlling program for the cleaning roller (see FIG. 4) and controls rotation velocity of the cleaning roller 82. Meanwhile, the third driving motor 93 provides a driving source to drive the presser 86 and controls the position of the support 88. The controller unit 90 controls activation of the third driving motor 93 according to a controlling program for the backup roller (see FIG. 5) and controls the positions of the swingable support 88. Thus, the controller unit 90 controls an orientation of the swingable support 88 and adjusts the position of the backup roller 85 with respect to the cleaning roller 82 so that the nipping force to nip the conveyer belt 53 between the cleaning roller 82 and the backup roller 85.

Next, a flow to control the cleaning roller 82 according the cleaning roller controlling program will be described with reference to FIG. 4. The controlling flow can be activated simultaneously in parallel with the known image forming program and can be activated whilst the laser printer 1 is initially in print standby state. When in the print standby state, the laser printer 1 is ready to receive a print instruction from an external device (e.g., a personal computer), and the cleaning roller 82 stands still without being rotated. Further, in the print standby state, the backup roller 85 is maintained at a position to be in contact with the upper inner surface of the conveyer belt 53 but to be prevented from being pressed against the cleaning roller 82 so that the conveyer belt 53 is not forced to have convexities or protuberance on the surface thereof by the pressure.

When the controlling flow is activated, in S1, the controller unit 90 judges as to whether the print instruction from the external device is received. According to the present embodiment, the print instruction includes print data, which represents the image to be printed by the image forming unit 20. When the controller unit 90 judges that the print instruction is received (S1: YES), the flow proceeds to S2. If no print instruction is received (S2: NO), the controller unit 90 repeats S1 and waits for the print instruction. Thus, the print standby state is maintained until the print instruction is received.

In S2, the controller unit 90 executes a pre-print operation. The pre-print operation is an accompanying preparatory operation for the image-forming operation of the image forming unit 20, which is performed according to the known image forming program, and is performed prior to the image-forming operation. In particular, in the image forming unit 20, the orientation of the sheet P can be corrected in the sheet-feeding path by the register rollers 15, and in the fixing unit 60, the heat roller 61 can be warmed up. In S2, the controller unit 90 controls the first driving motor 91 to convey the conveyer belt 53 at the conveying velocity B. Furthermore, the controller unit 90 controls the second driving motor 92 to rotate the cleaning roller 82 at a first rotation velocity Vs.

In S2, the cleaning roller 82 is rotated in a predetermined direction (e.g., counterclockwise in FIG. 2), which is a direction opposite from the rolling direction of the conveyer belt 53 (e.g., from right to left in FIG. 2). Therefore, in the pre-print operation, the conveyer belt 53 is pulled frontward by the cleaning roller 82 and rearward by the driving roller 51, in particular, at the image transfer range C. In other words, the cleaning roller 82 and the driving roller 51 tensely pull the conveyer belt 53 in the front-rear direction in cooperation with each other, and the surface of the conveyer belt 53 is straightened at the image transfer range C. The flow proceeds to S3.

In S3, the controller unit 90 judges as to whether the pre-print operation has been completed. Completion of the pre-print operation can be determined based on progress of the running image forming program. When the pre-print operation was completed (S3: YES), the flow proceeds to S4. When the pre-print operation is incomplete (S3: NO), the controller unit 90 returns to S2 and waits until the pre-print operation is completed.

In S4, the controller unit 90 executes a print operation. The print operation is executed in synchronization with the image forming operation, which is performed by the image forming unit 20 according to the known image forming program. In particular, in S4, the controller unit 90 activates the first driving motor 91. Thus, the sheet P on the conveyer belt 53 is conveyed by the first driving motor 91 in the predetermined direction (see FIG. 2) at the conveying velocity B, the toner images are transferred onto the sheet P on the conveyer belt 53, and the transferred images are thermally fixed on the sheet P by the fixing unit 60. Further, the controller unit 90 activates the second driving motor 92 to rotate the cleaning roller 82 at a second rotation velocity Vh, which is higher than the first rotation velocity Vs. The flow proceeds to S5.

In S4, the cleaning roller 82 is rotated in the predetermined direction (e.g., counterclockwise in FIG. 2), which is the direction opposite from the rolling direction of the conveyer belt 53 (e.g., from right to left in FIG. 2). Therefore, in the print operation, the conveyer belt 53 is pulled frontward by the cleaning roller 82 and rearward by the driving roller 51, in particular, at the image transfer range C. In this regard, the cleaning roller 82 rotates in the second rotation velocity Vh, which is faster than the first rotation velocity Vs. Therefore, the tensile force applied to the conveyer belt 53 is greater, and the conveyer belt 53 is pulled more tensely by the cleaning roller 82 and the driving roller 51 than the conveyer belt 53 in the pre-print operation in S2. Accordingly, the conveyer belt 53 is straightened and stretched more firmly at the image transfer range C. Thus, the positional relation between the sheet P on the conveyer belt 53 and the image forming unit 20 can be steadily maintained, and the image-forming quality of the laser printer 1 can be maintained.

In S5, the controller unit 90 judges as to whether the print operation has been completed. Completion of the print operation can be determined based on progress of the running image forming program. When the print operation was completed (S5: YES), the flow proceeds to S6. When the print operation is incomplete (S5: NO), the controller unit 90 returns to S4 and waits until the print operation is completed.

In S6, the controller unit 90 executes a post-print operation. The post-print operation is an accompanying aftercare operation for the image-forming operation of the image forming unit 20, which is performed according to the known image forming program, and is performed after the image-forming operation. In particular, in the image forming unit 20, the residual toner is removed from the surface of the conveyer belt 53 by the cleaning roller 82. In S6, the controller unit 90 controls the second driving motor 92 to rotate the cleaning roller 82 at the first rotation velocity Vs.

In S6, the cleaning roller 82 rotated in the predetermined direction (e.g., counterclockwise in FIG. 2) at the first velocity Vs pulls the conveyer belt 53 in the front-rear direction in cooperation with the driving motor 51 at the image transfer range C. Therefore, the conveyer belt 53 is pulled tensely, and the surface of the conveyer belt 53 is straightened at the image transfer range C. Accordingly, the cleaning roller 82 can thoroughly and effectively remove the residual toner from the straightened surface of the conveyer belt 53. The flow proceeds to S7.

In S7, the controller unit 90 judges as to whether the post-print operation has been completed. Completion of the post-print operation can be determined based on progress of the running image forming program. When the post-print operation was completed (S7: YES), the flow proceeds to S8. When the post-print operation is incomplete (S7: NO), the controller unit 90 returns to S6 and waits until the post-print operation is completed.

In S8, the controller unit 90 executes a print standby operation, in which the first driving motor 91 and the second driving motor 92 are inactivated, and the conveyer belt 53 and the cleaning unit 80 are placed in the print standby state. Thereafter, the flow returns to S1.

As has been described above, according to the first embodiment, the laser printer 1 can switch the rotation velocity of the cleaning roller 82 between the first rotation velocity Vs and the second rotation velocity Vh. Therefore, the tension necessary to straighten the surface of the conveyer belt 53 during the pre-print operation, the print operation, and the post-print operation can be changed on the basis of the operation. In other words, during a period other than the pre-print/print/post-print operations, that is, during the print standby state, the tension to straighten the conveyer belt 53 may be moderated, or the conveyer belt 53 may even be released from the tensile force. Accordingly, the conveyer belt 53 is prevented from having convexities or protuberance on the surface thereof by the tensile force.

Second Embodiment

Next, a second embodiment according to the present invention will be described. The laser printer 1 in the second embodiment includes a plurality of similarly-configured components to those in the laser printer 1 according to the first embodiment. Therefore, description of such similar components will be omitted. In the second embodiment, however, the conveyer belt 53 is straightened tensely and loosened by changing positions of the cleaning roller 82 instead of changing rotation velocities of the cleaning roller 82. The position of the cleaning roller 82 is changed in a backup roller controlling flow, which will be described below. Further, in the second embodiment, the controlling flow can be activated simultaneously in parallel with the known image forming program and can be activated whilst the laser printer 1 is initially in print standby state. When in the print standby state, the laser printer 1 is ready to receive a print instruction from an external device (e.g., a personal computer), and the backup roller 85 is in a position to be apart from the upper inner surface of the conveyer belt 53 (see FIG. 6). In the second embodiment, a distance between a center (a rotation axis) of the backup roller 85 and a center (a rotation axis) of the cleaning roller 82, when the backup roller 85 is in the print standby position, will be referred to as a distance D.

The controlling flow to control the backup roller 85 will be described with reference to FIG. 5. When the controlling flow is activated, in S11, the controller unit 90 judges to determine as to whether the print instruction from the external device is received. When the controller unit 90 judges that the print instruction is received (S11: YES), the flow proceeds to S12. If no print instruction is received (S12: NO), the controller unit 90 repeats S11 and waits for the print instruction. Thus, the print standby state is maintained until the print instruction is received.

In S12, the controller unit 90 executes a pre-print operation. In particular, the controller unit 90 controls the third driving motor 93 to manipulate the support 88 and move the backup roller 85 in a first position (see FIG. 7). The first position is a position, in which the circumferential surface of the backup roller 85 is in contact with the upper inner surface of the conveyer belt 53, and the backup roller 85 nips the conveyer belt 53 with moderate pressure in cooperation with the cleaning roller 82. When the backup roller 85 is in the first position, the center of the backup roller 85 and the center of the cleaning roller 82 are apart from each other at first distance Ds.

In S12, therefore, the conveyer belt 53 is nipped by the cleaning roller 82 and the backup roller 85 in the position vicinity to the cleaning roller 82 and simultaneously moved in the rolling direction of the conveyer belt 53 (e.g., from right to left in FIG. 2). Therefore, in the pre-print operation, the conveyer belt 53 is pulled rearward by the driving roller 51 whilst the conveyer belt 53 is caught between cleaning roller 82 and the backup roller 85, in particular, at the image transfer range C. In other words, the driving roller 51 tensely pulls the conveyer belt 53 rearward in cooperation with the cleaning roller 82 and the backup roller 85. Thus, and the surface of the conveyer belt 53 is straightened at the image transfer range C. The flow proceeds to S13.

In S13, the controller unit 90 judges as to whether the pre-print operation has been completed. When the pre-print operation was completed (S13: YES), the flow proceeds to S14. When the pre-print operation is incomplete (S13: NO), the controller unit 90 returns to S12 and waits until the pre-print operation is completed.

In S14, the controller unit 90 executes the print operation. In particular, the controller unit 90 activates the third driving motor 93 to manipulate the support 88 and moves the backup roller 85 to a second position (see FIG. 8). The second position is a position, in which the circumferential surface of the backup roller 85 is in contact with the upper inner surface of the conveyer belt 53, and the backup roller 85 nips the conveyer belt 53 with more intense pressure in cooperation with the cleaning roller 85. When the backup roller 85 is in the second position, the center of the backup roller 85 and the center of the cleaning roller 82 are apart from each other at second distance Dh, which is smaller than the first distance Ds (see FIGS. 7 and 8). Therefore, the backup roller 85 in the second position can nip the conveyer belt 53 more intensely in cooperation with the cleaning roller 82.

When the conveyer belt 53 is tensely straightened within the image transfer range C by the driving roller 51, the cleaning roller 82, and the backup roller 85, the backup roller 85 in the second position presses the conveyer belt 53 more intensely against the cleaning roller 82. Therefore, the cleaning roller 82 and the backup roller 85 holds the conveyer belt 51 more firmly and may be straightened more tensely than the conveyer belt 53 in the pre-print operation in S12. Accordingly, the conveyer belt 53 is straightened and stretched more firmly at the image transfer range C. Thus, the positional relation between the sheet P on the conveyer belt 53 and the image forming unit 20 can be steadily maintained, and the image-forming quality of the laser printer 1 can be maintained. The flow proceeds to S15.

In S15, the controller unit 90 judges as to whether the print operation has been completed. When the print operation was completed (S15: YES), the flow proceeds to S16. When the print operation is incomplete (S15: NO), the controller unit 90 returns to S14 and waits until the print operation is completed.

In S16, the controller unit 90 executes a post-print operation. In particular, the controller unit 90 controls the third driving motor 93 to manipulate the support 88 and moves the backup roller 85 in the first position.

Thus, in S16, the driving roller 51 pulls the conveyer belt 53 rearward in cooperation with the backup roller 85 in the first position and the cleaning roller 82 at the image transfer range C. Therefore, the conveyer belt 53 is pulled tensely, and the surface of the conveyer belt 53 is straightened at the image transfer range C. Accordingly, the cleaning roller 82 can thoroughly and effectively remove the residual toner from the straightened surface of the conveyer belt 53. The flow proceeds to S17.

In S17, the controller unit 90 judges as to whether the post-print operation has been completed. When the post-print operation was completed (S17: YES), the flow proceeds to S18. When the post-print operation is incomplete (S17: NO), the controller unit 90 returns to S16 and waits until the post-print operation is completed.

Figure 6:
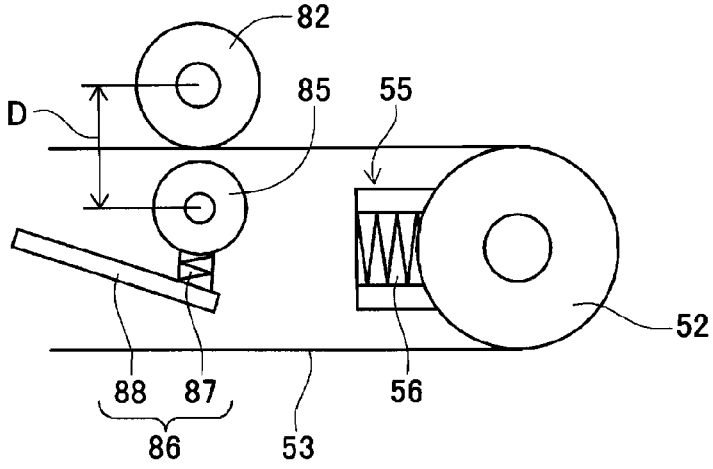
FIG. 6 illustrates movement of the cleaning unit in the laser printer in print standby state according to the embodiment of the present invention.

In S8, the controller unit 90 executes a print standby operation, in which the controller unit 90 controls the third driving motor 93 to move the backup roller 85 in the standby position (see FIG. 6). The cleaning unit 80 is placed in the print standby state, and the backup roller 85 is placed in the position to be apart from the cleaning roller 82 at the distance D and apart from the upper inner surface of the conveyer belt 53. Thereafter, the flow returns to S11.

According to the second embodiment, the laser printer 1 can switch the positions of the backup roller 85 between the first position and the second position, and the tension necessary to straighten the surface of the conveyer belt 53 during the pre-print operation, the print operation, and the post-print operation can be changed on the basis of the operation. In other words, during a period other than the pre-print/print/post-print operations, that is, during the print standby state, the tension to straighten the conveyer belt 53 may be moderated, or the conveyer belt 53 may even be released from the tensile force. Accordingly, the conveyer belt 53 is prevented from having convexities or protuberance on the surface thereof.

According to the above laser printer 1, in which the sheet P is carried in the predetermined direction within the image transfer area C in the transfer unit 50, the image formed by the image forming unit 20 is transferred onto the surface of the sheet P. The laser printer has the cleaning unit 80 in the position frontward with respect to the image transfer area C and rearward with respect to the driven roller 52. The cleaning unit 80 includes the cleaning roller 82, the backup roller 85, and the presser 86.

According to the above configuration, the laser printer 1 can control the rotation velocities of the cleaning roller 82 in accordance with the controlling program for the cleaning roller (see FIG. 4) when the laser printer 1 is in an image forming operation including the pre-print operation, the print operation, and post-print operation. Thus, the tensile force to be applied to the conveyer belt 53 at the image transfer range C can be controlled, and the conveyer belt 53 is conditioned for the image forming operation. Accordingly, the quality of the image formed on the sheet P being carried on the conveyer belt 53 is maintained.

Figure 4:
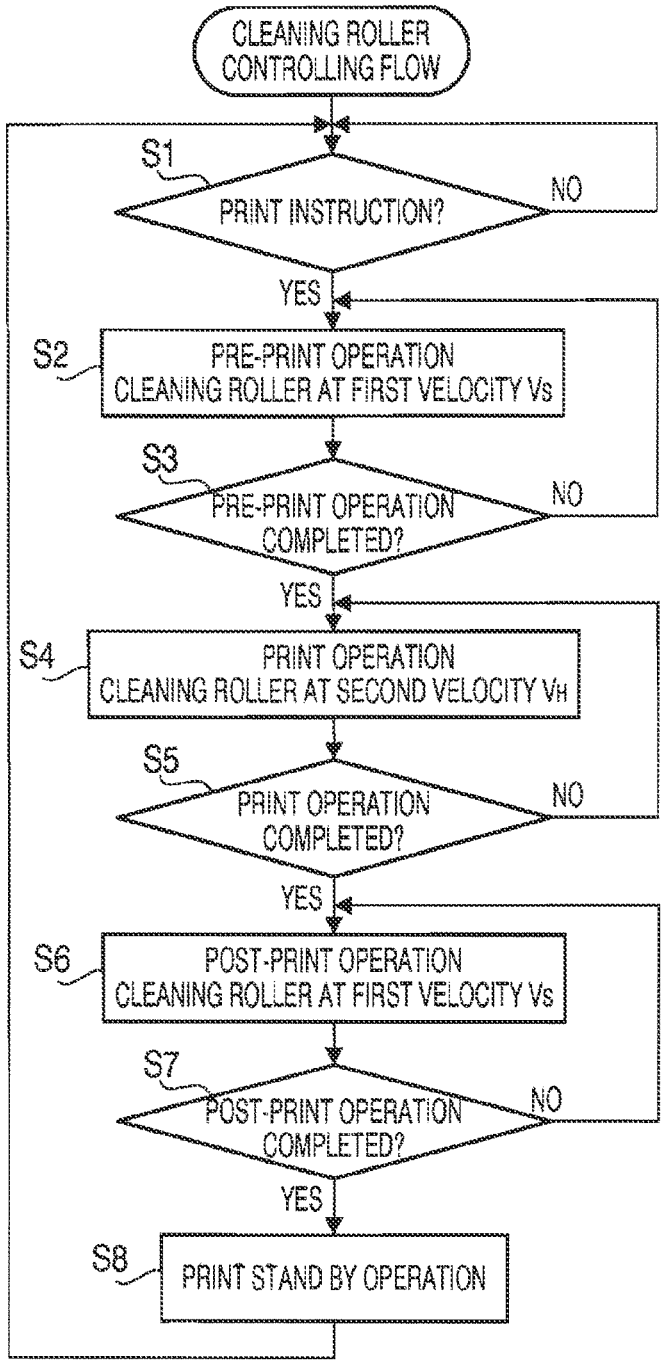
FIG. 4 is a flowchart to illustrate a cleaning roller controlling flow in the laser printer according to the embodiment of the present invention.
Figure 5:
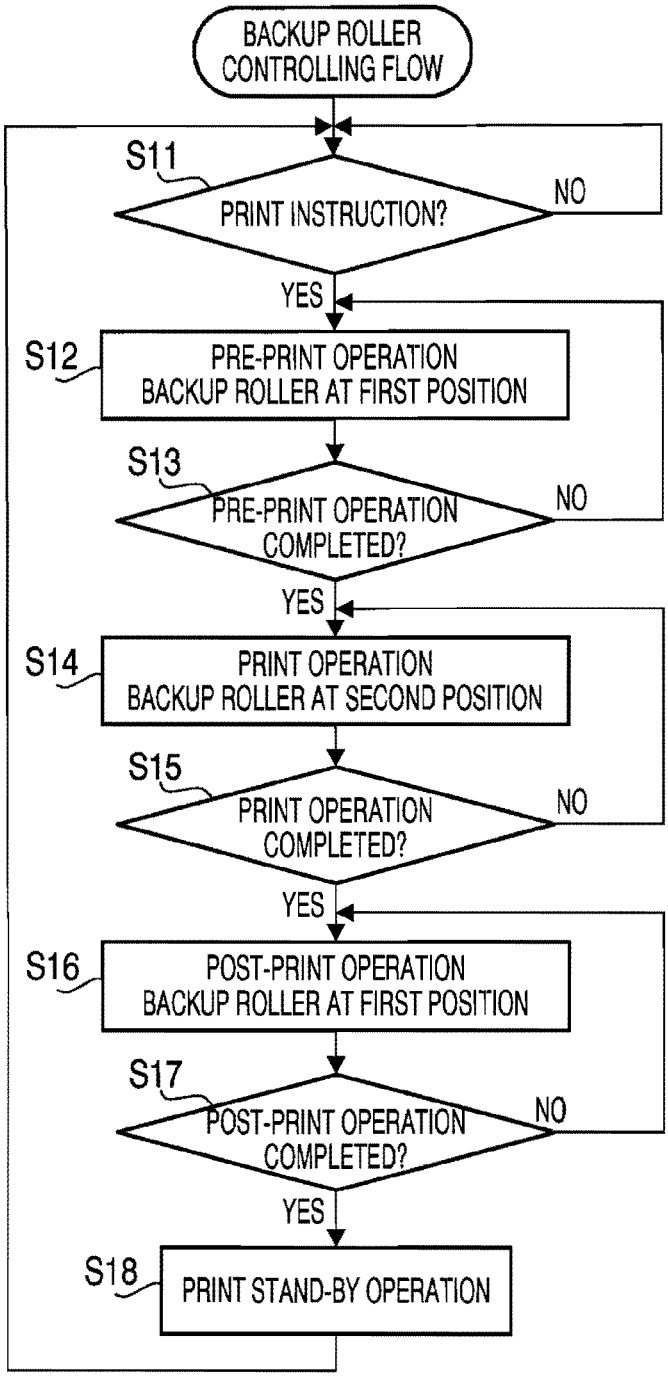
FIG. 5 is a flowchart to illustrate a backup roller controlling flow in the laser printer according to the embodiment of the present invention.

Further, according to the embodiments, when the laser printer 1 is in the print standby state, in which the conveyer belt 53 is not moved, rotation of the cleaning roller 82 is stopped by the controlling program for the cleaning roller (see FIG. 4), or the backup roller 85 is separated from the conveyer belt 53 by the controlling program for the backup roller 85 (see FIG. 5). Accordingly, the conveyer belt 53 is released from the tension caused by the cleaning unit 80 and loosened. In other words, the conveyer belt 53 is prevented from being exposed to excessive pressure for a longer period than it is necessary and is not forced to have convexities or protuberance on the surface thereof by the pressure. Therefore, the conveyer belt 53 can maintain the positional relation with the image forming unit 20, and the quality of the image formed on the sheet P being carried on the conveyer belt 53 is maintained.

According to the embodiments, the rotation velocities of the cleaning roller 82 are controlled by the controlling program for cleaning roller (see FIG. 4), and the positions of the backup roller 85 are controlled by the controlling program for backup roller (see FIG. 5) in order to place the conveyer belt 53 in the tensed condition within the image transfer range C during the pre-print operation and the post-print operation. Therefore, the operations accompanying the image forming operation can be effectively performed.

Further, according to the embodiments, the conveyer belt 53 is placed in the even more tensed condition within the image transfer range C during the print operation than the tensed condition during the pre-print and post-print operations. Therefore, the conveyer belt 53 is tensely and steadily straightened within the image transfer range C when the image is formed on the sheet P being carried on the conveyer belt 53, and the image-forming quality of the laser printer 1 can be maintained. Furthermore, the tension in the conveyer belt 53 is not constant but is changed between the pre-print operation and the print operation and between the print operation and the post-print operation. Therefore, the conveyer belt 53 is prevented from being exposed to excessive pressure for a longer period than it is necessary and is maintained in the operational condition for a longer term.

According to the embodiments, the cleaning unit 80 can remove the residual toner from the surface of the conveyer belt 53 in order to maintain the surface of the conveyer belt 53 clean. Further, the cleaning unit 80 applies the tensile force to the conveyer belt 53 in order to place the conveyer belt 53 in the image transfer range C in the stretched condition. Thus, the image-forming quality of the laser printer 1 can be maintained by the less complicated configuration having a smaller number of components compared to a laser printer, which has a cleaning unit and the tensile force applying unit separately.

Although examples of carrying out the invention have been described, those skilled in the art will appreciate that there are numerous variations and permutations of the image forming apparatus that falls within the spirit and scope of the invention as set forth in the appended claims. It is to be understood that the subject matter defined in the appended claims is not necessarily limited to the specific features or act described above. Rather, the specific features and acts described above are disclosed as example forms of implementing the claims.

For example, in the above embodiments, the tension to straighten the conveyer belt 53 in the image transfer range C is generated according to one of the controlling program for cleaning roller and the controlling program for backup roller. However, the controlling programs may be run concurrently so that the rotation velocities of the cleaning roller 82 are changed and the positions of the backup roller 85 are changed at the same time.

For another example, a shape of the backing for the cleaning roller 82 is not limited to a roller but may be in another shape as long as the backing part can press the conveyer belt 53 against the cleaning roller 82. Further, the cleaning roller 82 and the backup roller 85 may be replaced with, for example, a frictional component, which can become in contact with the conveyer belt 53 to produce resistance against the movement of the conveyer belt 53. Furthermore, the backup roller 85 may be omitted when the cleaning roller 82 can generate resistance against the movement of the conveyer belt 53 without the backing.

In the above second embodiment, the positions of the backup roller 85 are changed with respect to the cleaning roller 82 when the tension is generated in the conveyer belt 53. However, the backup roller 85 may be fixed at a position whilst the cleaning roller is movable with respect to the backup roller 85. Further, both of the cleaning roller 82 and the backup roller 85 may be moved to become in contact with and separated from the conveyer belt 53.

In the above embodiments, rotation velocities of the cleaning roller 82 and the positions of the backup roller 85 are changed during the pre-print operation and the post-print operation. However, the rotation velocities of the cleaning roller 82 and/or the positions of the backup roller 85 may not necessarily be controlled in the pre-print and post-print operations as described above. For example, the control may take place solely in one of the pre-print and post-print operations.

In the above embodiments, the cleaning roller 82 is rotated counterclockwise in FIG. 2 during the controlling flow for cleaning roller (see FIG. 4). However, the cleaning roller 82 may be rotated in the opposite direction, i.e., clockwise in FIG. 2. In this regard, the cleaning roller 82 is rotated in the same direction as the rolling direction of the conveyer belt 53. When the cleaning roller 82 rotates clockwise, the tension generated in the conveyer belt 53 is greater than the tension generated by the cleaning roller 82 rotating counterclockwise. Therefore, the second rotation velocity (S4 in FIG. 4) is designed to be greater than the first rotation velocity (S2, S6 in FIG. 4) in the controlling flow for cleaning roller.

What is claimed is:

1. An image forming apparatus, comprising:

an image forming unit configured to form an image to be transferred onto a transfer medium;

a seamless belt configured to move in a predetermined conveying direction to convey the transfer medium in an image transfer range, the seamless belt comprising:

a first section that extends from a first roller through the image transfer range to a second roller and faces the image forming unit; and a second section that extends from the first roller to the second roller and does not face the image forming unit, wherein the second section is on an opposite side of the first and second rollers than the first section;

a pair of belt rollers, including the first and second rollers, which are arranged in positions to define a most downstream portion and a most upstream portion of a stream of the belt moving in the predetermined conveying direction and configured to support the belt in a flattened condition;

a tensile force applier configured to contact the first section of the belt and generate resistance against the belt moving in the predetermined conveying direction to apply tensile force to the first section of the belt in the image transfer range, and configured to apply tensile force to flatten the first section in the image transfer range of the belt; and a controller configured to control the tensile force applier to apply the tensile force to the belt in the image transfer range during an imaging period, in which operations including an image transfer operation are executed, and control the tensile force applier to one of reduce and clear the tensile force being applied to the belt during a non-imaging period, which is a time period excluding the imaging period.

2. The image forming apparatus according to claim 1, wherein the imaging period includes an image transfer period, in which the image transfer operation to transfer the image formed in the image forming unit onto the transfer medium is executed, and an accompanying operation period, in which operations accompanying the image transfer operation are executed;

wherein the controller controls the tensile force applier to apply tensile force having a first intensity to the belt in the image transfer range during the accompanying operation period; and wherein the controller controls the tensile force applier to apply the tensile force having a second intensity, which is greater than the first intensity, to the belt during the image transfer period.

3. The image forming apparatus according to claim 1, wherein the tensile force applier includes a roller configured to contact the belt to generate the resistance against the moving belt; and wherein the roller is configured to rotate with a rotational velocity, which has a different magnitude than a moving velocity of the belt moving in the predetermined conveying direction.

4. The image forming apparatus according to claim 3, wherein the roller in the tensile force applier is configured to contact the first section of the belt at a point upstream with respect to the image transfer range along the predetermined conveying direction and rotate in a direction opposite from the predetermined conveying direction of the belt when the tensile force applier applies the tensile force to the belt.

5. The image forming apparatus according to claim 1, wherein the tensile force applier includes a pair of nippers, which are configured to nip the belt there-between; and wherein the controller controls the nippers to nip the belt there-between to apply the tensile force to the belt and release the belt therefrom to one of reduce and clear the tensile force being applied to the belt.

6. The image forming apparatus according to claim 1, wherein the tensile force applier includes a pair of nippers, which are configured to nip the belt there-between; and wherein the controller controls nipping pressure of the nippers to nip the belt there-between to one of apply, reduce, and clear the tensile force.

7. The image forming apparatus according to claim 1, wherein the tensile force applier includes a cleaning roller, which is configured to contact a surface of the belt facing the image forming unit and to remove residue from the surface of the belt.

8. The image forming apparatus according to claim 1, further comprising:

a guide member configured to provide a path to direct the transfer medium to the belt at a position between the tensile force applier and the image transfer range.

9. An image forming apparatus, comprising an image forming unit configured to form an image to be transferred onto a transfer medium;

a seamless belt configured to move in a predetermined conveying direction to convey the transfer medium in an image transfer range;

a pair of belt rollers, which are arranged in positions to define a most downstream portion and a most upstream end portion of a stream of the belt moving in the predetermined conveying direction and configured to support the belt in a flattened condition; and a roller configured to contact the belt and generate resistance against the belt moving in the predetermined conveying direction to apply tensile force to the belt in the image transfer range, configured to apply tensile force to flatten a section in the image transfer range of the belt, and configured to rotate with a rotational velocity, which has a different magnitude than a moving velocity of the belt moving in the predetermined conveying direction.

10. The image forming apparatus according to claim 9, wherein the roller is configured to contact an upstream section of the belt with respect to the image transfer range along the predetermined conveying direction and rotate in a direction opposite from the predetermined conveying direction of the belt when the roller applies the tensile force to the belt.

11. The image forming apparatus according to claim 9, further comprising:

a backing member configured to nip the belt in cooperation with the roller.

12. The image forming apparatus according to claim 11, wherein the roller is configured to contact a surface of the belt facing the image forming unit and to remove residue from the surface of the belt.

13. The image forming apparatus according to claim 9, further comprising:

a guide member configured to provide a path to direct the transfer medium to the belt at a position between the roller and the image transfer range.

14. An image forming apparatus, comprising:

an image forming unit configured to form an image to be transferred onto a transfer medium;

a seamless belt configured to move in a predetermined conveying direction to convey the transfer medium in an image transfer range, the seamless belt comprising:

a first section that extends from a first roller through the image transfer range to a second roller and faces the image forming unit; and a second section that extends from the first roller to the second roller and does not face the image forming unit, wherein the second section is on an opposite side of the first and second rollers than the first section;

a pair of belt rollers, including the first and second rollers, which are arranged in position to define a most downstream portion and a most upstream portion of a stream of the belt moving in the predetermined conveying direction and configured to support the belt in a flattened condition;

a tensile force applier configured to contact the first section of the belt and generate resistance against the belt moving in the predetermined conveying direction to apply the tensile force to the first section of the belt in the image transfer range, and configured to apply tensile force to flatten the first section in the image transfer range of the belt;

a controller configured to control the tensile force applier to apply the tensile force to the belt in the image transfer range during an imaging period, in which operations including an image transfer operation are executed, and control the tensile force applier to one of reduce and clear the tensile force being applied to the belt during a non-imaging period, which is a time period excluding the imaging period; and a guide member to provide a path to direct the transfer medium to the belt at a position between the tensile force applier and the image transfer range, wherein the tensile force applier includes a cleaning roller, which is configured to contact a surface of the belt facing the image forming unit and to remove residue from the surface of the belt.

15. The image forming apparatus according to claim 14, wherein the cleaning roller is configured to rotate with a rotational velocity, which has a different magnitude than a moving velocity of the belt moving in the predetermined conveying direction.

* * * * *